US005842811A

United States Patent [19]

Johnson

[11] Patent Number: 5,842,811

[45] Date of Patent: Dec. 1, 1998

[54] CONFINED SPACE MANHOLE SIGN SYSTEM

[76] Inventor: David B. Johnson, 19572 Phillips Rd., Brooksville, Fla. 34609

[21] Appl. No.: 804,231

[22] Filed: Feb. 21, 1997

[51] Int. Cl.[6] ..... E02D 29/14; E01C 11/22

[52] U.S. Cl. ..... 404/25; 404/2; 404/26

[58] Field of Search ..... 404/25, 26; 52/19, 52/20, 21; 428/43, 64.1, 66.3, 66.7

[56] References Cited

U.S. PATENT DOCUMENTS

| | | | |
|---|---|---|---|
| 4,170,839 | 10/1979 | O'Donnell | 46/17 |
| 4,454,039 | 6/1984 | McCoy | 210/163 |
| 4,500,580 | 2/1985 | Luciani | 428/43 |
| 4,648,740 | 3/1987 | Carlson | 404/25 |
| 4,650,365 | 3/1987 | Runnels | 404/25 |
| 4,794,956 | 1/1989 | Gordon et al. | 138/39 |
| 4,881,597 | 11/1989 | Hensley | 166/92 |
| 4,919,564 | 4/1990 | Neathery et al. | 404/25 |
| 5,328,291 | 7/1994 | Wisniewski | 404/2 |
| 5,401,114 | 3/1995 | Guggemos | 404/25 |
| 5,455,084 | 10/1995 | Spencer | 428/33 |

*Primary Examiner*—Tamara L. Graysay
*Assistant Examiner*—Sunil Singh

[57] ABSTRACT

A confined space manhole sign system for use in association with a manhole including a ledge and a manhole cover, the apparatus comprises a plurality of manhole insert members each having a circular base with an upper surface, an upstanding sidewall extending from the base and being formed contiguously therewith, two drain apertures being positioned at the intersection of the base and the sidewall, a flange being formed contiguously with the upstanding sidewall and extending radially therefrom, the flange having a lower surface including a plurality of perforation grooves formed therein; and a plurality of warning signs each having descriptive indicia marked thereupon, each of the warning signs being fixedly positionable upon the upper surface of the base, the system warning manhole workers of potentially dangerous situations within a manhole.

1 Claim, 5 Drawing Sheets

CONFINED SPACE MANHOLE SIGN SYSTEM

BACKGROUND OF THE INVENTION

1. Field of the Invention

The present invention relates to a confined space manhole sign system and more particularly pertains to warning manhole workers of possible dangers.

2. Description of the Prior Art

The use of manhole covers is known in the prior art. More specifically, manhole covers heretofore devised and utilized for the purpose of covering manholes are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,919,564 to Neathery et al. discloses a manhole sign system.

U.S. Pat. No. 4,650,365 to Runnels discloses a watertight manhole sign system.

U.S. Pat. No. 5,401,114 to Guggemos discloses a manhole ventilation sign system with duct shut-off device.

U.S. Pat. No. 5,549,411 to Hawkins discloses a manhole cover frame spacing arrangement.

While these devices fulfill their respective, particular objective and requirements, the aforementioned patents do not describe a confined space manhole sign system for warning manhole workers of possible dangers.

In this respect, the confined space manhole sign system according to the present invention substantially departs from the conventional concepts and designs of the prior art, and in doing so provides an apparatus primarily developed for the purpose of warning manhole workers of possible dangers.

Therefore, it can be appreciated that there exists a continuing need for new and improved confined space manhole sign system which can be used for warning manhole workers of possible dangers. In this regard, the present invention substantially fulfills this need.

SUMMARY OF THE INVENTION

In the view of the foregoing disadvantages inherent in the known types of manhole covers now present in the prior art, the present invention provides an improved confined space manhole sign system. As such, the general purpose of the present invention, which will be described subsequently in greater detail, is to provide a new and improved confined space manhole sign system and method which has all the advantages of the prior art and none of the disadvantages.

To attain this, the present invention essentially comprises a new and improved confined space manhole sign system comprising, in combination: a manhole formed in an elongated generally cylindrical configuration with an open upper end, the open upper end having an outboard section and an inboard section, the outboard section having a greater diameter than the inboard section thereby forming a ledge therebetween; a manhole cover being fabricated of metal and formed in a planar generally circular configuration, the cover having an upper surface and a lower surface, the upper surface of the manhole cover including a plurality of protrusions extending therefrom; a plurality of manhole insert members each being fabricated of transparent plastic and formed as a molded dish, each manhole insert having a circular base including a periphery and an upper surface, an upstanding sidewall having an upper edge and a lower edge, the upstanding sidewall extending approximately perpendicularly from the periphery of the base and being formed contiguously therewith, the base having a diameter (not including the flange) about five and one half times the height of the upstanding sidewall, two diametrically opposed drain apertures being positioned at the intersection of the base and the lower edge of the sidewall, each aperture being formed in a semi-circular configuration with a rounded upper edge and a linear lower edge, a flange being formed contiguously with the upper edge of the upstanding sidewall and extending radially therefrom, the flange having a lower surface including a plurality of perforation grooves formed therein in a circumfrential orientation, the perforation grooves permitting users to easily reduce the width of the flange by trimming the flange at the perforation grooves, a label being affixed to the upstanding sidewall of the insert, the label including the indicia NO STEP imprinted thereon; and a plurality of warning signs each having descriptive indicia marked thereupon, each of the warning signs being fixedly positionable upon the upper surface of a base, in an operative orientation a user placing the manhole insert member within the manhole with the flange of the manhole insert being positioned upon the ledge of the manhole, the user then placing the manhole cover upon the flange of the manhole insert, the system warning manhole workers of potentially dangerous situations within the manhole.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved confined space manhole sign system which has all the advantages of the prior art manhole covers and none of the disadvantages.

It is another object of the present invention to provide a new and improved confined space manhole sign system which may be easily and efficiently manufactured and marketed.

It is a further object of the present invention to provide a new and improved confined space manhole sign system which is of durable and reliable construction.

An even further object of the present invention is to provide a new and improved confined space manhole sign system which is susceptible of a low cost of manufacture with regard to both materials and labor, and which accordingly is then susceptible of low prices of sale to the consuming public, thereby making such a confined space manhole sign system economically available to the buying public.

Even still another object of the present invention is to provide a new and improved confined space manhole sign system for warning manhole workers of possible dangers.

Lastly, it is an object of the present invention to provide a new and improved confined space manhole sign system for use in association with a manhole including a ledge and a manhole cover, the apparatus comprising, in combination: a plurality of manhole insert members each formed as a molded dish, each manhole insert having a circular base with an upper surface, an upstanding sidewall extending from the base and being formed contiguously therewith, two drain apertures being positioned at the intersection of the base and the sidewall, a flange being formed contiguously with the upstanding sidewall and extending radially therefrom, the flange having a lower surface including a plurality of perforation grooves formed therein, the perforation grooves permitting users to easily reduce the width of the flange by trimming the flange at the perforation grooves; and a plurality of warning signs each having descriptive indicia marked thereupon, each of the warning signs. being fixedly positionable upon the upper surface of the base, in an operative orientation a user placing the manhole insert member within a manhole with the flange of the manhole insert being positioned upon a ledge of the manhole, the user then placing a manhole cover upon the flange of the manhole insert, the system warning manhole workers of potentially dangerous situations within a manhole.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
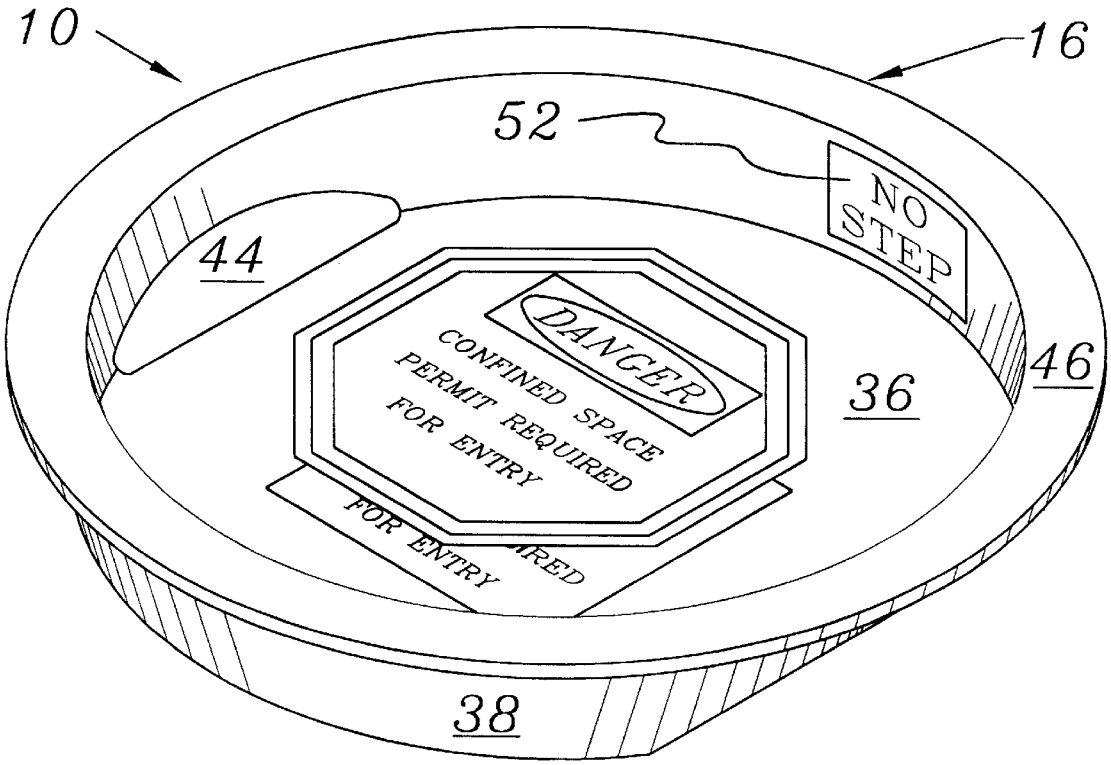
FIG. 1 is a perspective view of the preferred embodiment of the confined space manhole sign system constructed in accordance with the principles of the present invention.

With reference now to the drawings, and in particular, to FIG. 1 thereof, the preferred embodiment of the new and improved confined space manhole sign system embodying the principles and concepts of the present invention and generally designated by the reference number 10 will be described.

Specifically, it will be noted in the various Figures that the device relates to a confined space manhole sign system 10. In its broadest context, the device consists of a manhole 12, a manhole cover 14, a manhole insert 16 and a plurality of warning signs 18, 20, 22. Such components are individually configured and correlated with respect to each other so as to attain the desired objective.

Figure 2:
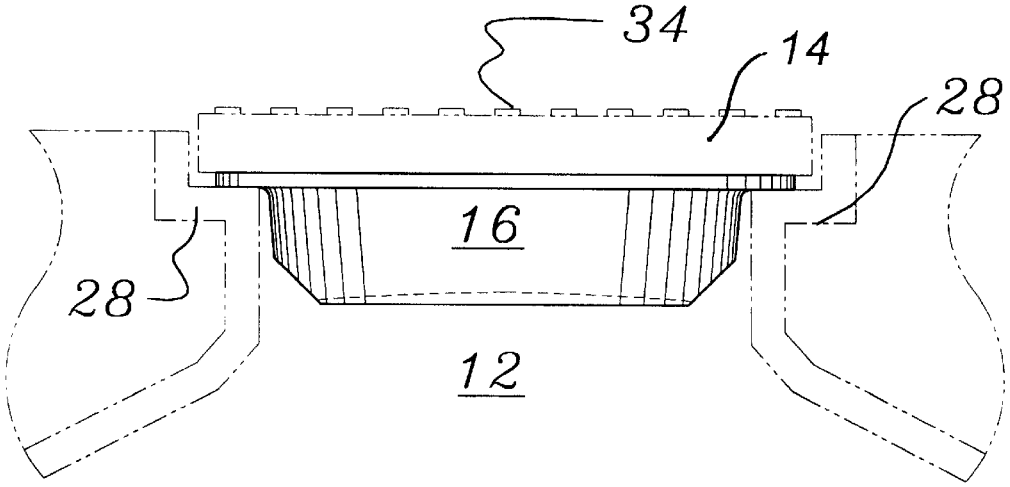
FIG. 2 is a side perspective view of the confined space manhole sign system illustrating the position of the insert within a manhole.
Figure 3:
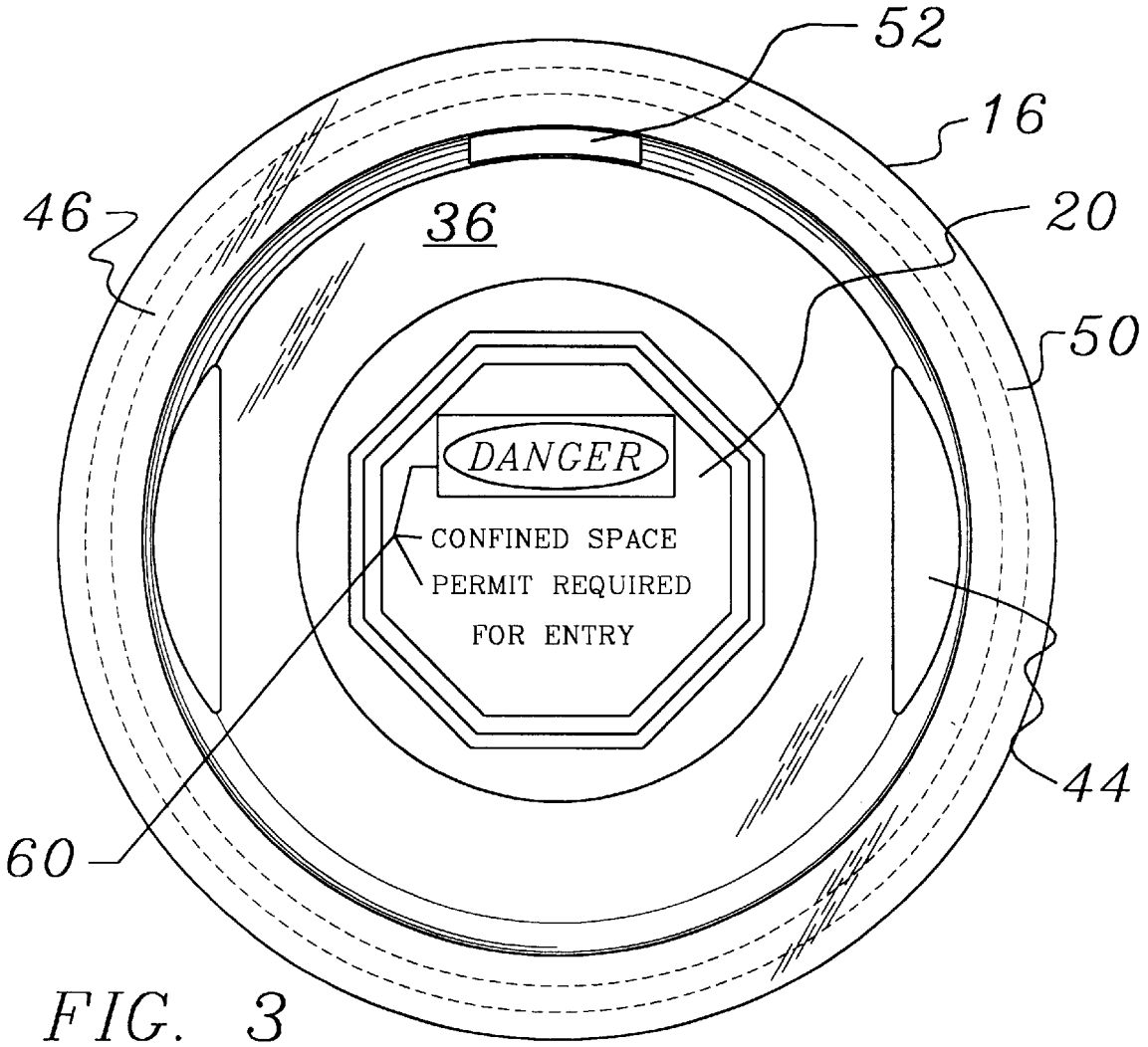
FIG. 3 is a top perspective view of the upper surface of the manhole sign system illustrating a danger sign.
Figure 4:
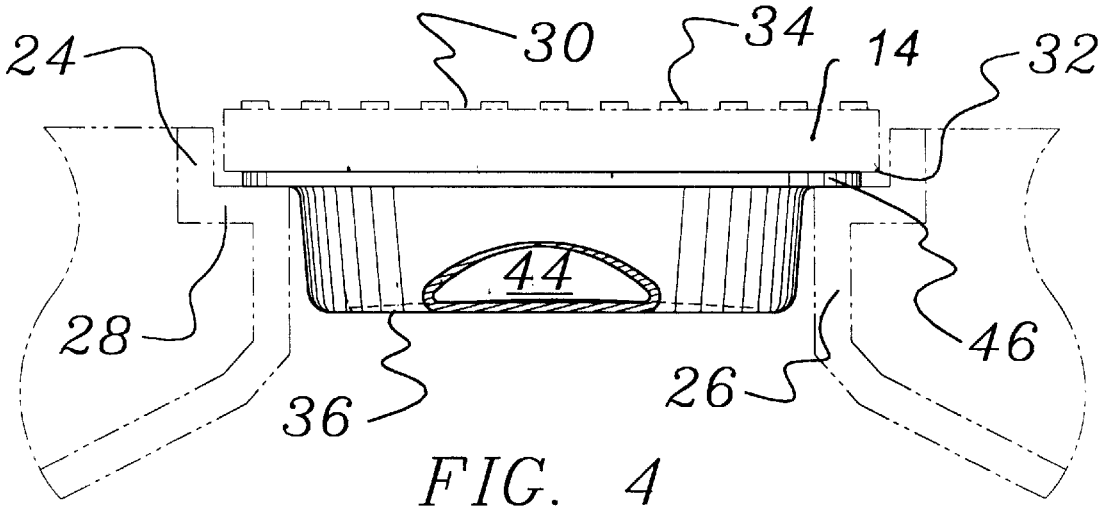
FIG. 4 is a side perspective view of the manhole sign system illustrating the drain apertures.
Figure 5:
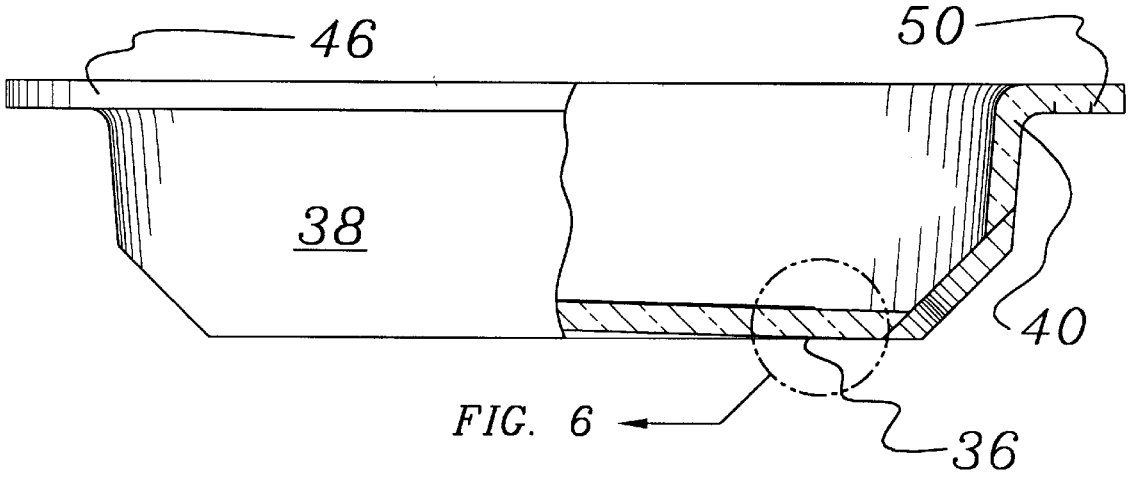
FIG. 5 is a cross-sectional view of the apparatus illustrating the positioning of a danger sign upon an insert member.
Figure 6:
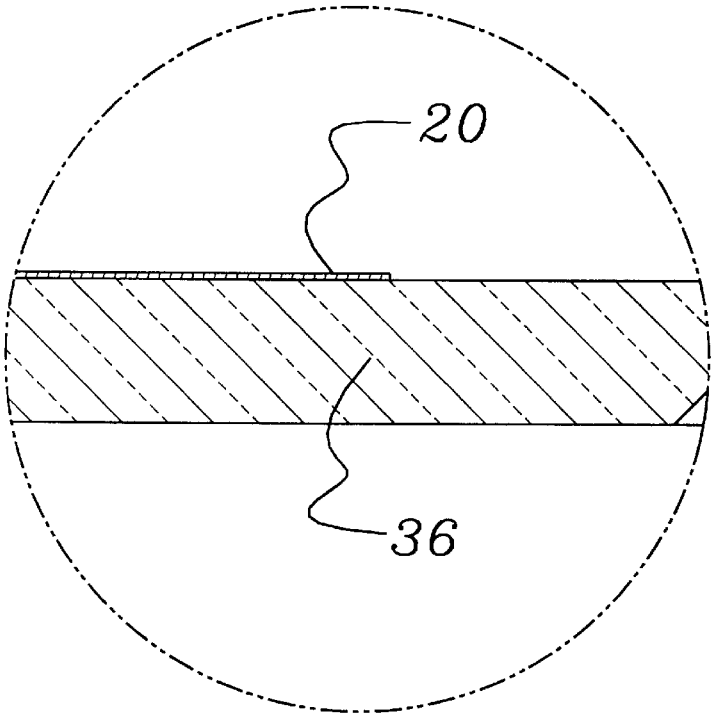
FIG. 6 is an enlarged perspective view taken along the section circle FIG. 6 illustrated in FIG. 5.
Figure 7:
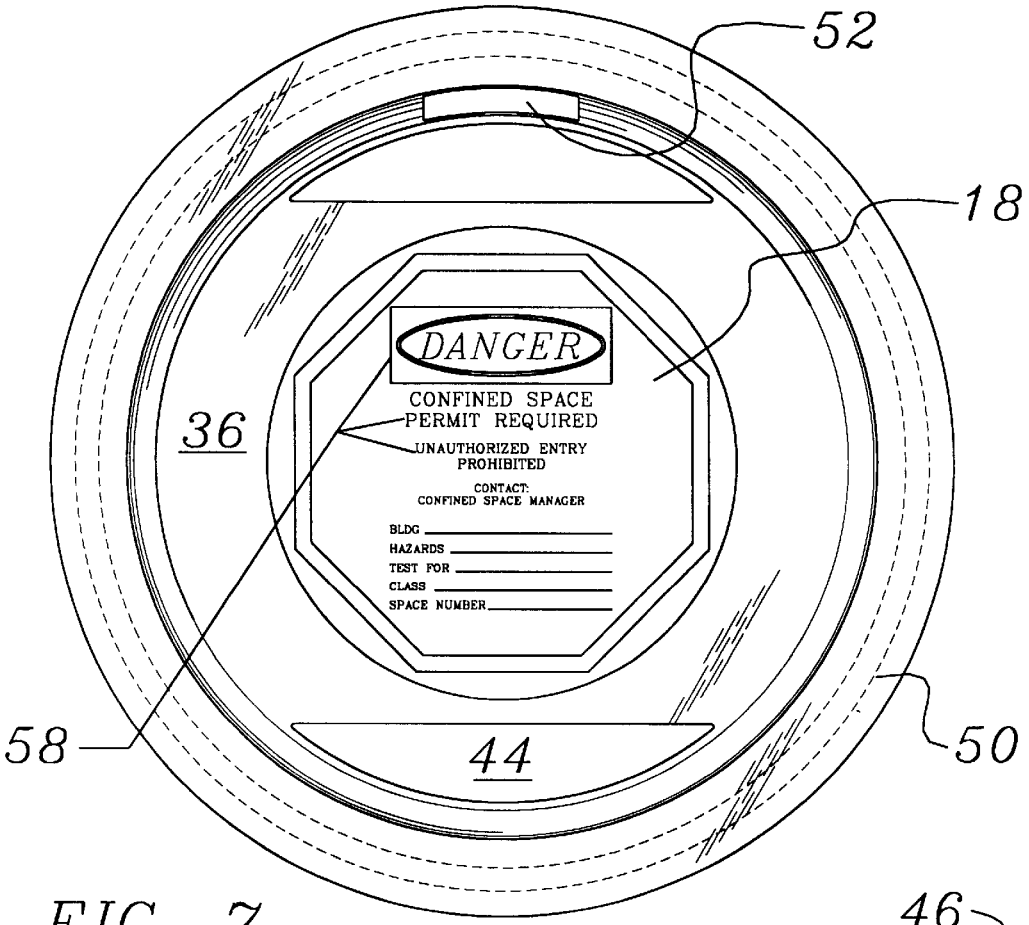
FIG. 7 is a top perspective view illustrating one of the danger signs of the system.
Figure 8:
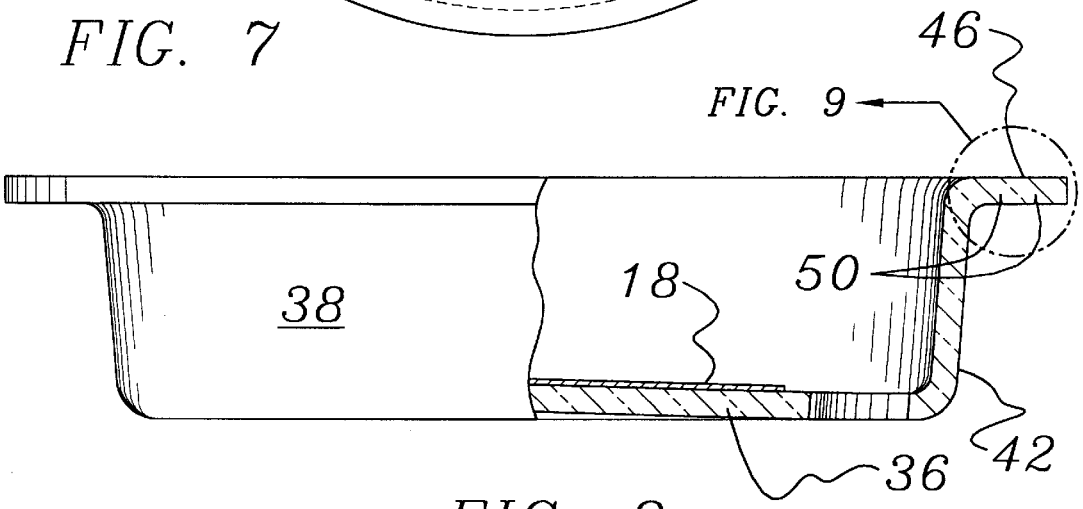
FIG. 8 is a cross sectional view illustrating the flange of the insert member.
Figure 9:
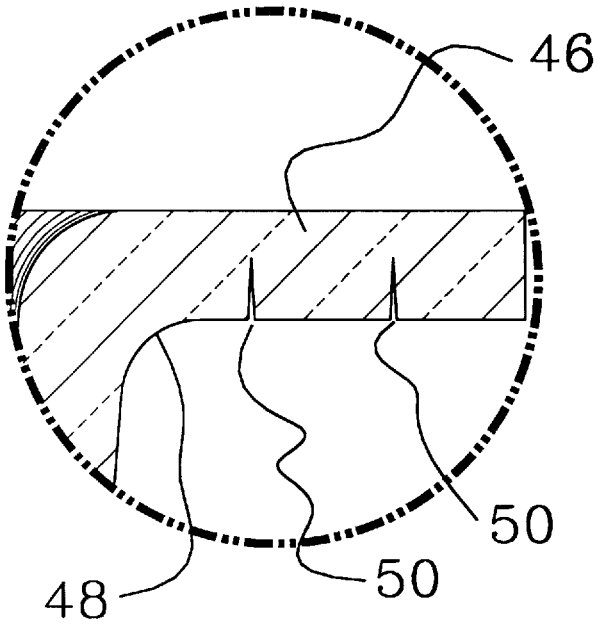
FIG. 9 is an enlarged perspective view depicting the perforation grooves taken along section circle FIG. 9 illustrated in FIG. 8.
Figure 10:
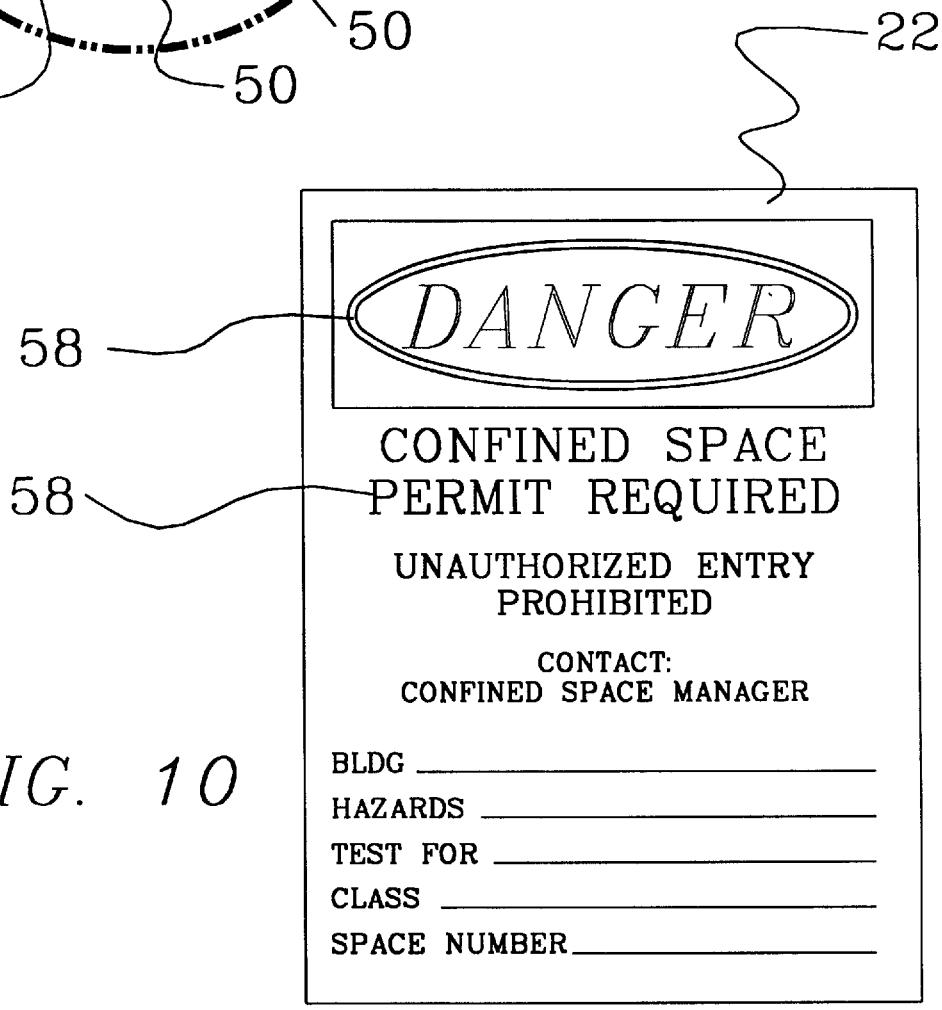
FIG. 10 is an enlarged perspective view of a danger sign of the system.

The manhole 12 is formed in an elongated generally cylindrical configuration with an open upper end. Conventional manholes are apertures in the pavement that are used to access sewer systems, septic tanks or subterranean tunnel systems. The open upper end has an outboard section 24 and an inboard section 26. The outboard section has a greater diameter than the inboard section, thereby forming a ledge 28. Note FIGS. 2 and 4.

In the preferred embodiment of the apparatus, the ledge is covered by a steel rim. Conventional manholes are constructed in four standard diameters, twenty four inches, twenty six inches, twenty eight inches and thirty inches. The present invention is adapted for use with conventional manholes as well as custom sizes. Note FIGS. 2 and 4.

The manhole cover 14 is fabricated of metal and formed in a planar generally circular configuration. The cover has an upper surface 30 and a lower surface 32. The upper surface of the manhole cover includes a plurality of protrusions 34 extending from its surface. This pattern creates a frictional surface for users walking across the surface of the manhole cover, or automobiles driving over the surface. The manhole cover is constructed to fit conventional size manholes. Note FIGS. 2 and 4.

A plurality of manhole insert members 16 are each fabricated of one-eighth inch thick high impact transparent plastic which is extremely weather resistant. In alternate embodiments of the apparatus the insert members are fabricated of a variety of different materials and colors. The construction is lightweight and permits easy handling of the insert. The insert members are each formed as a molded dish. This configuration allows the insert to fit snugly under standard manhole covers. Each manhole insert has a circular base 36 which includes a periphery and an upper surface. Note FIGS. 1–8.

An upstanding sidewall 38 has an upper edge 40 and a lower edge 42. The upstanding sidewall extends approximately perpendicularly from the periphery of the base and is formed contiguously with the base. In alternative embodiments of the apparatus, the upstanding sidewall projects upwardly from the base in an angular orientation. In the preferred embodiment of the apparatus, the base has a diameter (not including the flange) about five and one half times the height of the upstanding sidewall. In alternate embodiments of the apparatus the insert member has a diameter between about four and six times the height of the upstanding sidewall. Note FIGS. 1–4.

Two diametrically opposed drain apertures 44 are positioned at the intersection of the base and the lower edge of the sidewall. In the preferred embodiment of the apparatus each aperture is formed in a semi-circular configuration with a rounded upper edge and a linear lower edge. In alternative embodiments of the apparatus the aperture is formed in a variety of different configurations. The drain apertures allow water and air to flow through the insert to the area below the manhole. Additionally, the apertures are large enough to insert a probe through without having to remove the insert. The drain apertures could also be used as a handle to aid users in lifting the insert from the manhole. Note FIGS. 1, 3, 4 and 7.

A flange 46 is formed contiguously with the upper edge of the upstanding sidewall and extends radially from it. The flange has a lower surface 48 which includes a plurality of perforation grooves 50 formed in its surface. The perforation grooves are arranged in a circumfrential orientation. The perforation grooves 50 permit users to easily reduce the width of the flange by trimming the flange at the perforation grooves. The perforations are between one and two inches apart. This allows a user to trim the flange appropriately to fit a manhole ranging from 24–30 inches in diameter. A label 52 is affixed to the upstanding sidewall of the insert. The label includes the indicia NO STEP imprinted upon its surface. Note FIGS. 1, 3 and 7–9.

A plurality of warning signs 18, 20, 22 each having descriptive indicia 58, 60 marked upon their surfaces. In the preferred embodiment of the apparatus the signs are fabricated of overlaminated vinyl. This construction allows the signs to withstand extreme weather and environmental conditions and remain readable. The first sign 18 has a generally octagonal configuration and includes the indicia 58 DANGER CONFINED SPACE PERMIT REQUIRED, UNAUTHORIZED ENTRY PROHIBITED, CONTACT: CONFINED SPACE MANAGER, BLDG, HAZARDS, TEST FOR, CLASS, and SPACE NUMBER. The second sign 20 has a generally octagonal configuration and includes the indicia 60 DANGER CONFINED SPACE PERMIT REQUIRED FOR ENTRY. The third sign 22 has a generally rectangular configuration and includes the indicia 58 DANGER CONFINED SPACE PERMIT REQUIRED, UNAUTHORIZED ENTRY PROHIBITED, CONTACT: CONFINED SPACE MANAGER, BLDG, HAZARDS, TEST FOR, CLASS, and SPACE NUMBER. In alternative embodiments of the apparatus the signs are formed in a generally circular configuration and include CAUTION indicia marked upon their surfaces. Each of the warning signs is positionable upon the upper surface of the base 36. Note FIGS. 1, 3, 5, 7 and 10.

In an operative orientation a user places the manhole insert member 16 within the manhole 12 with the flange 46 of the manhole insert positioned upon the ledge 28 of the manhole. The user then places the manhole cover 14 upon the flange 46 of the manhole insert. The system warns manhole workers of potentially dangerous situations within the manhole, such as confined spaces, hazardous gasses or unbreathable atmospheres. Note FIGS. 1–4.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A manhole system comprising, in combination:

a manhole formed in an elongated generally cylindrical configuration with an open upper end, the open upper end having an outboard section and an inboard section, the outboard section having a greater diameter than the inboard section thereby forming a ledge therebetween which is covered with a steel rim;

a manhole cover being fabricated of metal and formed in a planar generally circular configuration, the cover having an upper surface and a lower surface, the upper surface of the manhole cover including a plurality of protrusions extending therefrom;

a plurality of manhole insert members each being fabricated of transparent plastic and formed as a molded dish, each manhole insert having a circular base including a periphery and an upper surface, an upstanding sidewall having an upper edge and a lower edge, the upstanding sidewall extending approximately perpendicularly from the periphery of the base and being formed contiguously therewith, the base having a diameter about five and one half times the height of the upstanding sidewall, two diametrically opposed drain apertures being positioned at the intersection of the base and the lower edge of the sidewall and residing in planes which are angled with respect to the base of the associated manhole insert member, each aperture being formed in a semi-circular configuration with a rounded upper edge and a linear lower edge, a flange being formed contiguously with the upper edge of the upstanding sidewall and extending radially therefrom, the flange having a lower surface including a plurality of perforation grooves formed therein in a circumfrential orientation, the perforation grooves permitting users to easily reduce the width of the flange by trimming the flange at the perforation grooves, a label being affixed to the upstanding sidewall of the insert, the label including the indicia NO STEP imprinted thereon; and a plurality of warning signs each having descriptive indicia marked thereupon and being constructed from an overlaminated vinyl, each of the warning signs being fixedly positionable upon the upper surface of the base, wherein the manhole insert member is situated within the manhole with the flange of the manhole insert being positioned upon the ledge of the manhole and the manhole cover is situated upon the flange of the manhole insert, whereby the system warns manhole workers of potentially dangerous situations within the manhole.

* * * * *